US011109733B2

(12) United States Patent
Yang et al.

(10) Patent No.: US 11,109,733 B2
(45) Date of Patent: Sep. 7, 2021

(54) CLEANING ROBOT

(71) Applicant: GuangDong BONA Robot Co., Ltd., Shenzhen (CN)

(72) Inventors: Kai Yang, Shenzhen (CN); Wenming Liu, Shenzhen (CN)

(73) Assignee: GuangDong BONA Robot Co., Ltd., Shenzhen (CN)

( * ) Notice: Subject to any disclaimer, the term of this patent is extended or adjusted under 35 U.S.C. 154(b) by 373 days.

(21) Appl. No.: 16/420,099

(22) Filed: May 22, 2019

(65) Prior Publication Data

US 2019/0274510 A1 Sep. 12, 2019

Related U.S. Application Data

(63) Continuation of application No. PCT/CN2017/090801, filed on Jun. 29, 2017.

(30) Foreign Application Priority Data

Feb. 25, 2017 (CN) ..... 201710105161.0

(51) Int. Cl.

| | |
|---|---|
| ***A47L 11/40*** | (2006.01) |
| ***A47L 11/24*** | (2006.01) |
| ***A47L 11/28*** | (2006.01) |

(52) U.S. Cl.

CPC ..... *A47L 11/4013* (2013.01); *A47L 11/24* (2013.01); *A47L 11/28* (2013.01); *A47L 11/4027* (2013.01); *A47L 11/4083* (2013.01)

(58) Field of Classification Search

CPC ..... A47L 11/4013; A47L 11/24; A47L 11/28; A47L 11/4083; A47L 11/4027

See application file for complete search history.

(56) References Cited

U.S. PATENT DOCUMENTS 5,940,931 A 8/1999 Jeon

FOREIGN PATENT DOCUMENTS

| | | | |
|---|---|---|---|
| CN | 204500539 | U | 7/2015 |
| CN | 205181229 | U | 4/2016 |
| CN | 105615769 | A | 6/2016 |
| CN | 205514386 | U | 8/2016 |
| CN | 205729246 | U | 11/2016 |
| CN | 205849387 | U | 1/2017 |
| CN | 205923919 | U | 2/2017 |
| JP | 2009273680 | A | 11/2009 |

OTHER PUBLICATIONS

International Search Report issued in corresponding International Application No. PCT/US2017/090801, dated Nov. 16, 2017, 5 pages.

(Continued)

*Primary Examiner* — David Redding
(74) *Attorney, Agent, or Firm* — Bayes PLLC

(57) ABSTRACT

The present disclosure discloses a cleaning robot, including a water tank, a dust box, and a main body. The water tank and the dust box are assembled together to form a water tank dust box assembly. The main body includes an accommodating space adapted to accommodate the water tank dust box assembly. The water tank dust box assembly includes a mistake-proofing device. The mistake-proofing device, when the water tank and the dust box are not assembled to form the water tank dust box assembly, is in an ejected state so that the water tank or the dust box cannot be installed into the accommodating space.

20 Claims, 3 Drawing Sheets

(56) References Cited

OTHER PUBLICATIONS

Written Opinion of the International Searching Authority issued in corresponding International Application No. PCT/US2017/090801, dated Nov. 16, 2017, 3 pages.
First Office action issued in corresponding Chinese Application No. 201710105161.0, dated Sep. 30, 2017, 3 pages.
Second Office action issued in corresponding Chinese Application No. 201710105161.0, dated Dec. 28, 2017, 3 pages.
International Search Report issued in Chinese Application No. 2017101051610, filed Feb. 25, 2017, 1 page.
Supplemental Search Report issued in Chinese Application No. 2017101051610, filed Feb. 25, 2017, 1 page.

CLEANING ROBOT

CROSS REFERENCE TO RELATED APPLICATION

This application is continuation of International Application No. PCT/CN2017/090801, filed on Jun. 29, 2017, entitled "CLEANING ROBOT," which claims priority to Chinese Patent Application No. 201710105161.0, filed on Feb. 25, 2017, both of which are hereby incorporated by reference in their entireties.

BACKGROUND

The present disclosure relates to the field of service robots, in particular to a cleaning robot for indoor ground cleaning.

In addition to components of a general cleaning robot, a cleaning robot having a ground wiping function currently on the market also includes a water tank. In order to save space inside the cleaning robot and facilitate a user to disassemble and install the water tank and the dust box, the water tank and the dust box are often assembled together.

However, after removing the water tank and dust box from the main body of the cleaning robot, a user needs to take apart the water tank and dust box, and then refill and clean the water tank and the dust box, respectively. After the refill or cleaning is finished, the user will often forget to assemble the water tank and dust box together before putting them back into the main body of the cleaning robot, rather directly put the individual water tank or dust box back into the main body of the cleaning robot, which causes the cleaning robot to work abnormally and even damage the cleaning robot.

The current means of solving the above technical problem includes detecting whether the water tank or dust box is installed in a specific location through a switch or a sensor, otherwise the cleaning robot will issue an alarm or prompt that the water tank or dust box is not properly installed. The above means has the following defects:

1. The control is relatively complex;
2. An additional switch or sensor is needed, increasing the cost of the cleaning robot.

SUMMARY

In order to solve the technical problem in the background art, the technical solution used by the present disclosure is as follows:

A cleaning robot includes a water tank, a dust box, and a main body, the water tank and the dust box being assembled together to form a water tank dust box assembly. The main body is provided with an accommodating space suitable for accommodating the water tank dust box assembly. The water tank dust box assembly also includes a mistake-proofing device. The mistake-proofing device is in an ejected state when the water tank and the dust box are not assembled to form the water tank dust box assembly, so that the water tank or the dust box cannot be installed into the accommodating space. The mistake-proofing device includes an ejecting rod, a spring abutting one end of the ejecting rod, and a receiving cavity for mounting the ejecting rod. The ejecting rod is provided with a limiting block, the receiving cavity is provided with a limiting surface, and the limiting block abuts on the limiting surface. The water tank and the dust box are assembled together through a fastening device. The fastening device includes a spring, a moving body, and a mounting part. One end of the moving body abuts on the spring, and the other end forms a limiting surface, the limiting surface protruding to form a fastening hook. A switch for operation is provided on a side of the moving body. The mounting part is used to fix the moving body to the water tank or the dust box. The mounting part is provided with a limiting part in contact with the limiting surface.

Further, the mistake-proofing device is mounted on the water tank, and the dust box is provided with a pressure block. The pressure block is used to abut the ejecting rod, so that the water tank and the dust box are assembled together to form the water tank dust box assembly which can then be installed into the accommodating space.

Further, the mistake-proofing device is mounted on the dust box, and the water tank is provided with a pressure block. The pressure block is used to abut the ejecting rod, so that the water tank and the dust box are assembled together to form the water tank dust box assembly which can then be installed into the accommodating space.

Further, the fastening device is mounted on the water tank, and the dust box is provided with a fastening part cooperating with the fastening hook.

Further, the fastening device is mounted on the dust box, and the water tank is provided with a fastening part cooperating with the fastening hook.

Optionally, a fastening hook inclined surface is formed on the fastening hook.

Further, a guiding rail and a guiding groove cooperating with one another are also included.

Optionally, the guiding rail is arranged on the water tank, and the guiding groove is arranged on the dust box.

A cleaning robot includes a water tank, a dust box, and a main body, the water tank and the dust box being assembled together to form a water tank dust box assembly. The main body is provided with an accommodating space suitable for accommodating the water tank dust box assembly. The water tank dust box assembly also includes a mistake-proofing device. The mistake-proofing device is in an ejected state when the water tank and the dust box are not assembled to form the water tank dust box assembly, so that the water tank or the dust box cannot be installed into the accommodating space.

Further, in a specific embodiment of the present disclosure, the mistake-proofing device includes an ejecting rod, a spring abutting one end of the ejecting rod, and a receiving cavity for mounting the ejecting rod. The ejecting rod is provided with a limiting block, the receiving cavity is provided with a limiting surface, and the limiting block abuts the limiting surface.

Optionally, the mistake-proofing device is mounted on the water tank, and the dust box is provided with a pressure block. The pressure block is used to abut the ejecting rod, so that the water tank and the dust box are assembled together to form the water tank dust box assembly which can then be installed into the accommodating space.

Optionally, the mistake-proofing device is mounted on the dust box, and the water tank is provided with a pressure block. The pressure block is used to abut the ejecting rod, so that the water tank and the dust box are assembled together to form the water tank dust box assembly which can then be installed into the accommodating space.

Further, in a specific embodiment of the present disclosure, the water tank and dust box are assembled together through a fastening device. The fastening device includes a spring, a moving body, and a mounting part. One end of the moving body abuts the spring, and the other end forms a limiting surface, the limiting surface protruding to form a fastening hook. A switch for operation is provided on a side of the moving body. The mounting part is used to fix the moving body to the water tank or the dust box. The mounting part is provided with a limiting part in contact with the limiting surface.

Optionally, the fastening device is mounted on the water tank, and the dust box is provided with a fastening part cooperating with the fastening hook.

Optionally, the fastening device is mounted on the dust box, and the water tank is provided with a fastening part cooperating with the fastening hook.

Further, a fastening hook inclined surface is formed on the fastening hook, which makes the fastening hook more prone to displacement when it is squeezed.

Further, a guiding rail and a guiding groove cooperating with one another are also included, making the installation of the water tank and the dust box more convenient.

Further, in a specific embodiment of the present disclosure, the guiding rail is arranged on the water tank, and the guiding groove is arranged on the dust box.

Compared with the prior art, the beneficial effect of the present disclosure is:

The present disclosure has the advantages of simple control and low cost by providing the mistake-proofing device, so that the water tank and the dust box of the cleaning robot cannot be installed separately into the accommodating space of the main body when they are not assembled to form the water tank dust box assembly.

BRIEF DESCRIPTION OF THE DRAWINGS

In order to more clearly explain the technical solution of the embodiments of the present disclosure, the following will be a brief introduction of the drawings to be used in the embodiments. It is obvious that the drawings in the following description are some embodiments of the present disclosure, and for a person having ordinary skill in the art, other drawings can also be obtained on the basis of these drawings without involving inventive skills.

DETAILED DESCRIPTION

A clear and complete description of the technical solution of the present disclosure will be provided in conjunction with the drawings and detailed embodiments. It is clear that the embodiments described here are only part of the embodiments of the present disclosure, not all embodiments. Based on the detailed embodiments described in the present disclosure, all other embodiments obtained by a person having ordinary skill in the art without inventive skills shall fall within the scope of protection as defined by the claims of the present disclosure.

FIG. 1 to FIG. 8 are schematic diagrams of a cleaning robot and its constituent components according to a preferred embodiment of the present disclosure.

Figure 1:
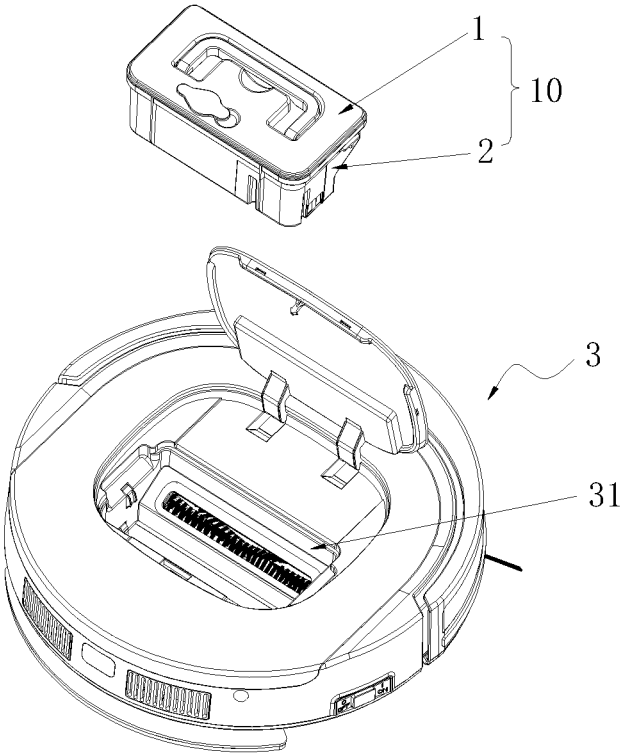
FIG. 1 is a schematic diagram of a cleaning robot of a preferred embodiment of the present disclosure.
Figure 2:
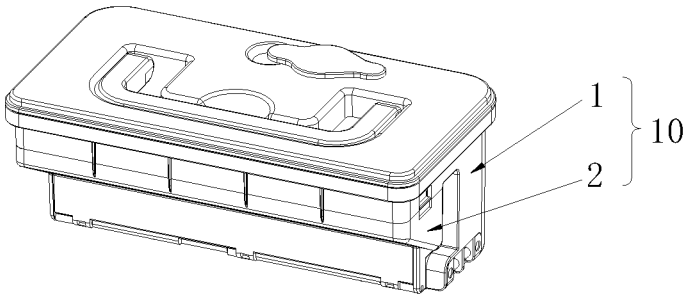
FIG. 2 is a schematic diagram of the water tank dust box assembly in FIG. 1.

Referring to FIGS. 1 to 2, the cleaning robot in this embodiment includes a water tank 1, a dust box 2, and a main body 3. Water tank 1 and dust box 2 are assembled together in a detachable manner to form a water tank dust box assembly 10. Main body 3 is provided with an accommodating space 31 suitable for accommodating water tank dust box assembly 10. The "suitability" herein refers to that accommodating space 31 is slightly larger than water tank dust box assembly 10, so that water tank dust box assembly 10, after being installed in accommodating space 31, does not occur a large wobble.

Figure 3:
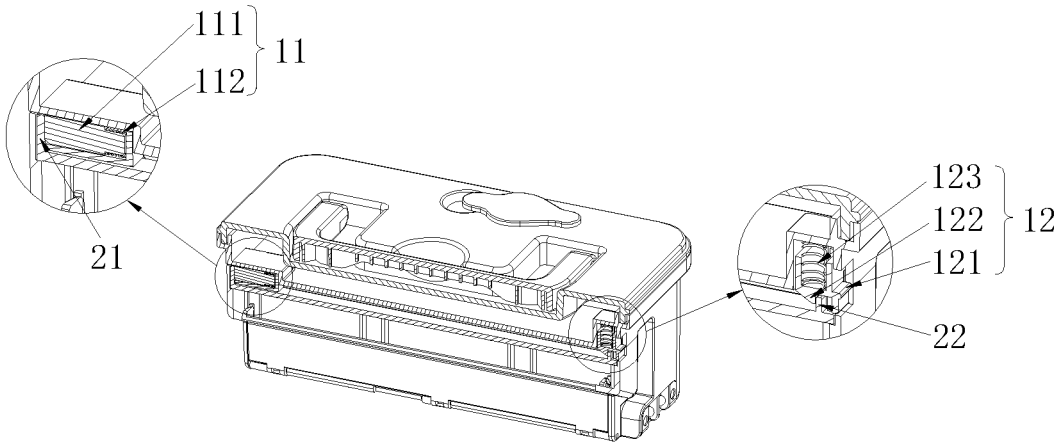
FIG. 3 is a sectional view of FIG. 2.

As shown in FIG. 3 to FIG. 6, water tank dust box assembly 10 also includes a mistake-proofing device 11. Mistake-proofing device 11 is installed on water tank 1. When water tank 1 and dust box 2 are assembled together, mistake-proofing device 11 is in a compressed state (FIG. 3). When water tank 1 and dust box 2 are separated, mistake-proofing device 11 in an ejected state (FIG. 5), so that water tank 1 cannot be installed into accommodating space 31.

Figure 7:
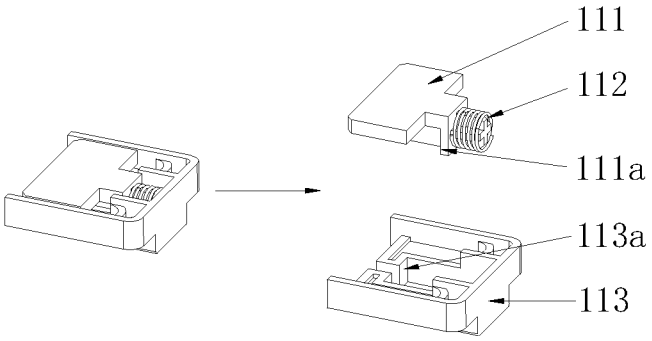
FIG. 7 is a schematic diagram of a mistake-proofing device in a preferred embodiment of the present disclosure.

As shown in FIG. 7, mistake-proofing device 11 in the present embodiment includes an ejecting rod 111, a spring 112 abutting one end of ejecting rod 111, and a receiving cavity 113 for mounting ejecting rod 111. Ejecting rod 111 can move in receiving cavity 113. Ejecting rod 111 is provided with a limiting block 111*a* and receiving cavity 113 is provided with a limiting surface 113*a*. Ejecting rod 111 is prevented from being pushed out of receiving cavity 113 by spring 112 through the abutting of limiting block 111*a* and limiting surface 113*a*. Mistake-proofing device 11 can be screwed onto water tank 1 or fixed directly to water tank 1 in a tight fit.

Figure 4:
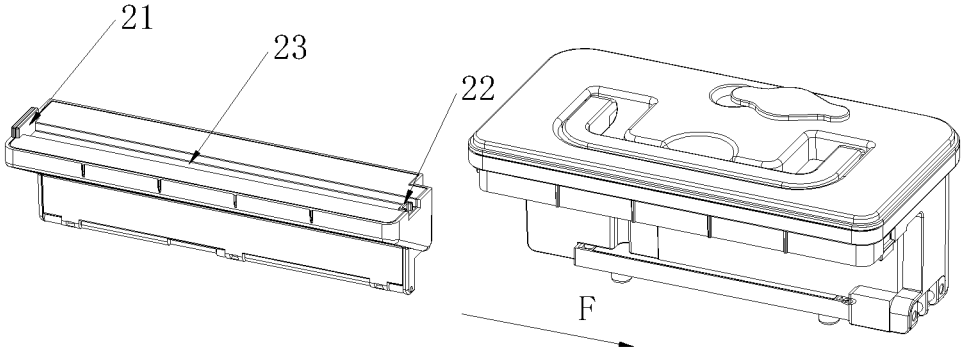
FIG. 4 is a schematic diagram of the water tank and the dust box in FIG. 2 after being separated.
Figure 5:
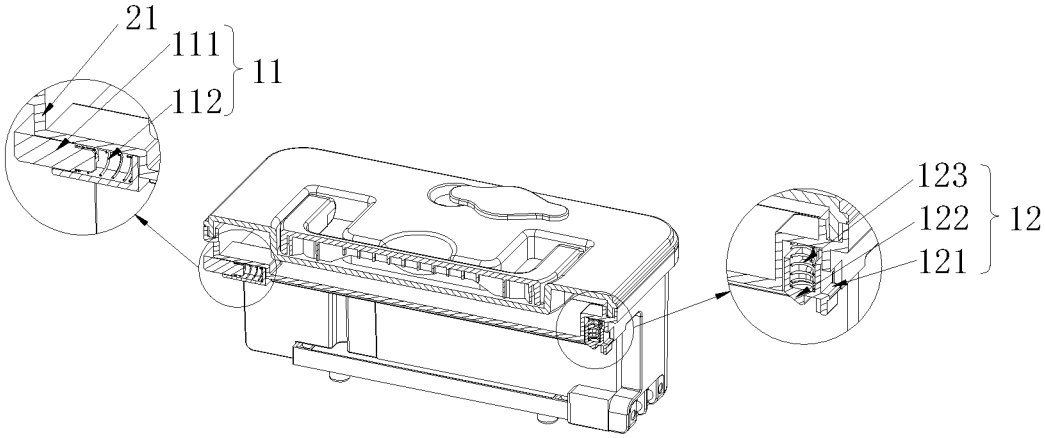
FIG. 5 is a sectional view of the water tank in FIG. 4.

As shown in FIG. 3 and FIG. 4, dust box 2 is provided with a pressure block 21 for abutting ejecting rod 111, so that after water tank 1 and dust box 2 are assembled together to form water tank dust box assembly 10, water tank dust box assembly 10 can be installed into accommodating space 31.

It will be readily apparent to those skilled in the art that mistake-proofing device 11 can be placed on dust box 2, and pressure block 21 can be placed on water tank 1, and the same effect can be achieved.

Figure 6:
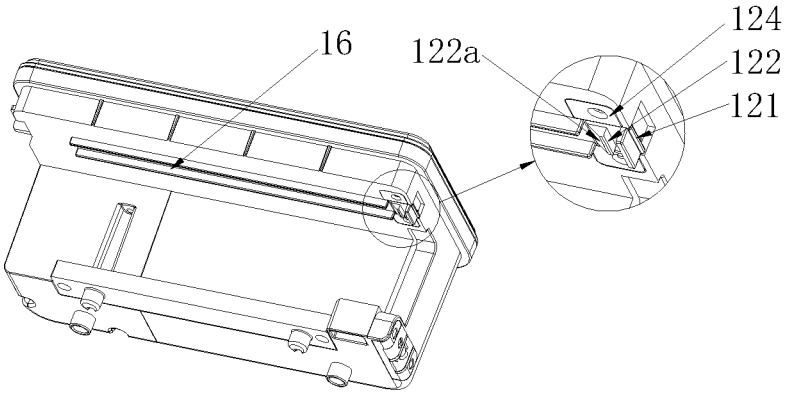
FIG. 6 is another perspective view of the water tank in FIG. 4.
Figure 8:
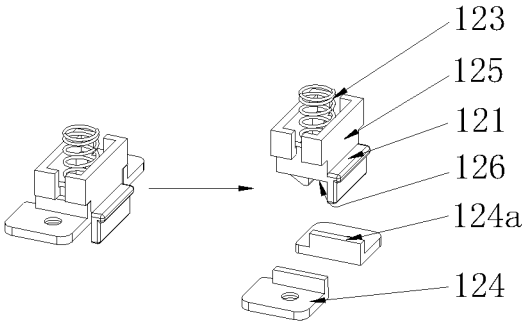
FIG. 8 is a schematic diagram of a fastening device in a preferred embodiment of the present disclosure.

As shown in FIG. 6 and FIG. 8, water tank 1 and dust box 2 are assembled together by a fastening device 12 mounted on water tank 1 to form water tank dust box assembly 10. Fastening device 12 includes a spring 123, a moving body 125, and a mounting part 124. Moving body 125 is movable relative to mounting part 124. One end of moving body 125 abuts spring 123, and the other end of moving body 125 forms a limiting surface 126. Limiting surface 126 protrudes to form a fastening hook 122. A switch 121 for operation is provided on a side of moving body 125. Switch 121 protrudes from the side of moving body 125 and has a substantially strip shape. A user can hold switch 121 by fingers to move moving body 125 against the elastic force of spring 123. Mounting part 124 is used to fix (such as by screws) moving body 125 to water tank 1. Mounting part 124 is provided with a limiting part 124*a* in contact with limiting surface 126 for limiting the range of motion of moving body 125.

As shown in FIG. 3 and FIG. 4, dust box 2 is provided with a fastening part 22 that cooperates with fastening hook 122. Fastening part 22 has an approximate "〔" shape. Fastening hook 122 is formed with a fastening hook inclined surface 122*a*, which makes fastening part 22 more easily pressing fastening hook 122 and displacing fastening hook 122. When dust box 2 moves along the direction F, fastening part 22 abuts fastening hook inclined surface 122*a* formed by fastening hook 122, compresses spring 123, and then continues to move until fastening hook 122 being caught in fastening part 22. At the same time, pressure block 21 presses spring 112 through ejecting rod 111, causing spring 112 to compress, thereby pressing ejecting rod 111 into receiving cavity 113.

It will be readily apparent to those skilled in the art that fastening device 12 can be placed on dust box 2, and fastening part 22 can be placed on water tank 1 to achieve the same effect.

As shown in FIG. 4 and FIG. 6, in order to facilitate the installation of water tank 1 and dust box 2, water tank 1 is provided with a guiding rail 16, which in the present embodiment is two protruding strip-shaped parts formed on the surface of water tank 1. Dust box 2 is provided with a guiding groove 23 cooperating with guiding rail 16. In the present embodiment, guiding groove 23 is a groove formed by recessing the surface of dust box 2 downward. A user can assemble water tank 1 and dust box 2 together by inserting guiding rail 16 into guiding groove 23.

It will be readily apparent to those skilled in the art that guiding rail 16 can be placed on dust box 2, and guiding groove 23 can be placed on water tank 1, and the same effect can be achieved.

What has been disclosed above is only some embodiments of the technical solution of the present disclosure, and the scope of the present disclosure is not limited thereto. Therefore, equivalent variations according to the claims of the present disclosure are still within the scope of the present disclosure.

What is claimed is:

1. A cleaning robot, comprising:
a fastening device;
a water tank;
a dust box, the water tank and the dust box are adapted to be assembled together by the fastening device to form a water tank dusk box assembly; and
a main body comprising an accommodating space adapted to accommodate the water tank dust box assembly, wherein
the water tank dust box assembly includes a mistake-proofing device adapted to, when the water tank and the dust box are not assembled together, be in an ejected state so that the water tank or the dust box cannot be installed into the accommodating space;
the mistake-proofing device comprises an ejecting rod having a limiting block, a spring abutting one end of the ejecting rod, and a receiving cavity having a first limiting surface adapted to mount the ejecting rod when the limiting block abuts the first limiting surface; and
the fastening device includes (i) a spring, (ii) a moving body having a first end abutting the spring and a second end forming a second limiting surface, and (iii) a mounting part having a limiting part in contact with the second limiting surface and adapted to fix the moving body to the water tank or the dust box.

2. The cleaning robot of claim 1, wherein
the mistake-proofing device is mounted on the water tank; and
the dust box comprises a pressure block adapted to abut the ejecting rod so that the water tank and the dust box are assembled together to form the water tank dust box assembly and then installed into the accommodating space.

3. The cleaning robot of claim 1, wherein
the mistake-proofing device is mounted on the dust box; and
the water tank comprises a pressure block adapted to abut the ejecting rod so that the water tank and the dust box are assembled together to form the water tank dust box assembly and then installed into the accommodating space.

4. The cleaning robot of claim 1, wherein
the second limiting surface protrudes to form a fastening hook;
the fastening device is mounted on the water tank; and
the dust box comprises a fastening part cooperating with the fastening hook.

5. The cleaning robot of claim 4, wherein the fastening hook comprises a fastening hook inclined surface.

6. The cleaning robot of claim 1, wherein
the second limiting surface protrudes to form a fastening hook;
the fastening device is mounted on the dust box; and
the water tank comprises a fastening part cooperating with the fastening hook.

7. The cleaning robot of claim 6, wherein the fastening hook comprises a fastening hook inclined surface.

8. The cleaning robot of claim 1, further comprising a guiding rail and a guiding groove cooperating with one another.

9. The cleaning robot of claim 8, wherein the guiding rail is provided on the water tank, and the guiding groove is provided on the dust box.

10. A cleaning robot, comprising:
a water tank;
a dust box, the water tank and the dust box are adapted to be assembled together to form a water tank dusk box assembly; and
a main body comprising an accommodating space adapted to accommodate the water tank dust box assembly,
wherein the water tank dust box assembly includes a mistake-proofing device adapted to, when the water tank and the dust box are not assembled together, be in an ejected state so that the water tank or the dust box cannot be installed into the accommodating space.

11. The cleaning robot of claim 10, wherein the mistake-proofing device comprises an ejecting rod having a limiting block, a spring abutting one end of the ejecting rod, and a receiving cavity having a first limiting surface adapted to mount the ejecting rod when the limiting block abuts the first limiting surface.

12. The cleaning robot of claim 11, wherein
the mistake-proofing device is mounted on the water tank; and
the dust box comprises a pressure block adapted to abut the ejecting rod so that the water tank and the dust box are assembled together to form the water tank dust box assembly and then installed into the accommodating space.

13. The cleaning robot of claim 11, wherein
the mistake-proofing device is mounted on the dust box; and
the water tank comprises a pressure block adapted to abut the ejecting rod so that the water tank and the dust box are assembled together to form the water tank dust box assembly and then installed into the accommodating space.

14. The cleaning robot of claim 10, further comprising a fastening device adapted to assemble the water tank and the dust box together and comprising:

a spring;

a moving body having a first end abutting the spring and a second end forming a second limiting surface protruding to form a fastening hook;

a mounting part having a limiting part in contact with the second limiting surface and adapted to fix the moving body to the water tank or the dust box; and a switch for operation on a side surface of the moving body.

15. The cleaning robot of claim 14, wherein the fastening device is mounted on the water tank; and the dust box comprises a fastening part cooperating with the fastening hook.

16. The cleaning robot of claim 15, wherein the fastening hook comprises a fastening hook inclined surface.

17. The cleaning robot of claim 14, wherein the fastening device is mounted on the dust box; and the water tank comprises a fastening part cooperating with the fastening hook.

18. The cleaning robot of claim 17, wherein the fastening hook comprises a fastening hook inclined surface.

19. The cleaning robot of claim 10, further comprising a guiding rail and a guiding groove cooperating with one another.

20. The cleaning robot of claim 19, wherein the guiding rail is provided on the water tank, and the guiding groove is provided on the dust box.

* * * * *